United States Patent [19]

Bullock

[11] 4,162,786

[45] Jul. 31, 1979

[54] JOB SEPARATION BY A SKEWED TROUGH IN THE PAPER PATH

[75] Inventor: Michael K. Bullock, Boulder County, Colo.

[73] Assignee: International Business Machines Corporation, Armonk, N.Y.

[21] Appl. No.: 826,618

[22] Filed: Aug. 22, 1977

Related U.S. Application Data

[63] Continuation-in-part of Ser. No. 727,873, Sep. 29, 1976, abandoned.

[51] Int. Cl.[2] ..... B65H 29/58

[52] U.S. Cl. ..... 271/64; 226/197; 271/184; 271/251

[58] Field of Search ..... 271/250, 251, 184–186, 271/63, 64, 172; 226/197, 196; 360/81, 88

[56] References Cited

U.S. PATENT DOCUMENTS

| | | | |
|---|---|---|---|
| 380,001 | 3/1888 | Tucker | 101/222 |
| 1,628,225 | 5/1927 | Bradshaw | 271/13 |
| 1,873,860 | 8/1932 | Balletti | 214/11 R |
| 2,823,788 | 2/1958 | Chase | 198/33 |
| 3,137,499 | 6/1964 | Maidment | 271/71 |
| 3,432,084 | 3/1969 | Van Den Bussche | 226/197 |
| 3,548,783 | 12/1970 | Knapp | 226/197 X |
| 3,671,035 | 6/1972 | Reist | 271/185 X |
| 3,709,596 | 1/1973 | Ulmer | 355/109 |
| 3,735,978 | 5/1973 | Turner | 271/88 |
| 3,851,872 | 12/1974 | Gerbasi | 271/173 |
| 3,860,127 | 1/1975 | Fassman | 214/6 N |
| 4,019,435 | 4/1977 | Davis | 101/232 |
| 4,084,198 | 4/1978 | Lemelson | 360/81 X |

OTHER PUBLICATIONS

IBM Technical Disclosure Bulletin, vol. 17, No. 6, Nov. 1974, Pneumatic Threading Tunnel, R. J. Godsoe and G. Sabol, pp. 1552–1553.

*Primary Examiner*—Richard A. Schacher
*Attorney, Agent, or Firm*—Francis A. Sirr

[57] ABSTRACT

The method and apparatus for offsetting sheets laterally with respect to their travel in a predetermined direction along a path. The method includes directing the sheets away from the path and through a second curved path aligned in skewed relation to their direction of travel in the original path and then directing the sheets back into the original path. Where some sheets are selectively fed through the second path and others only along the original path, they all can then be collected in a single stack in laterally offset relation to each other. The apparatus for offsetting the sheets includes feeding means for feeding the sheets in the predetermined direction along the original path and guide structure for directing the sheets along the curved path. The guide structure is curved about an axis skewed relative to the direction of travel of the sheets along their original path to effect the offsetting.

27 Claims, 15 Drawing Figures

FIG. 1
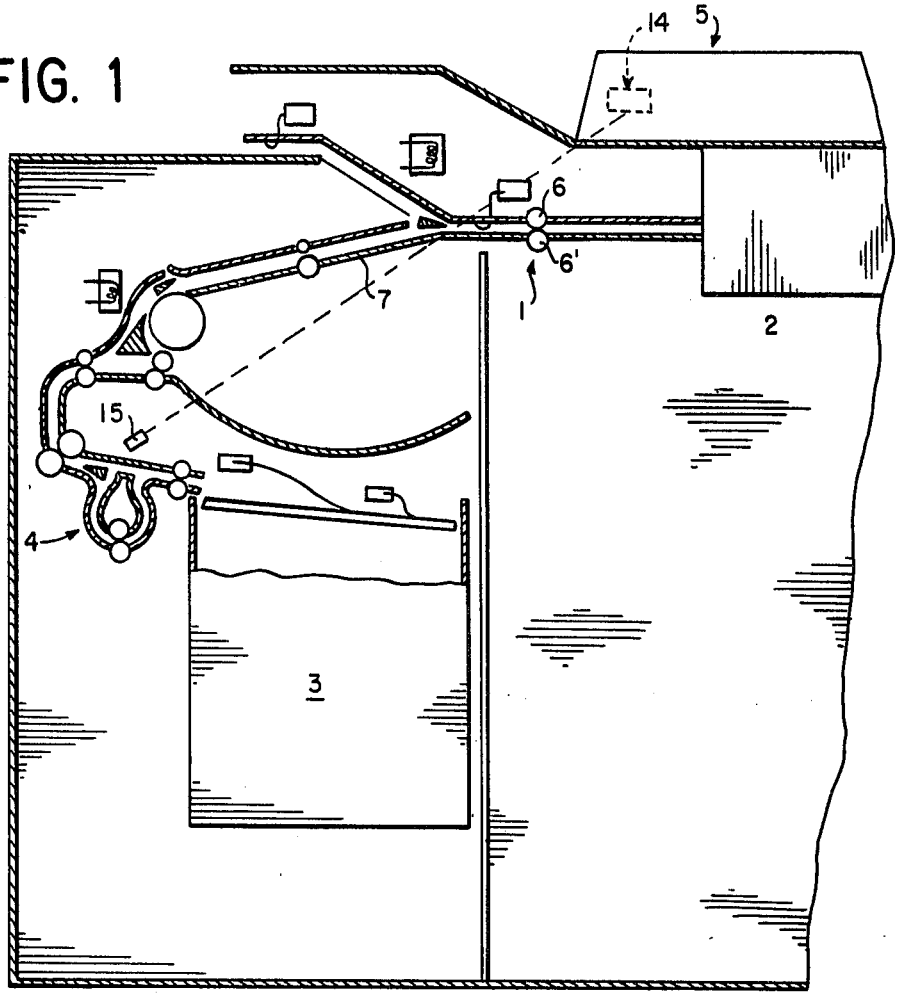
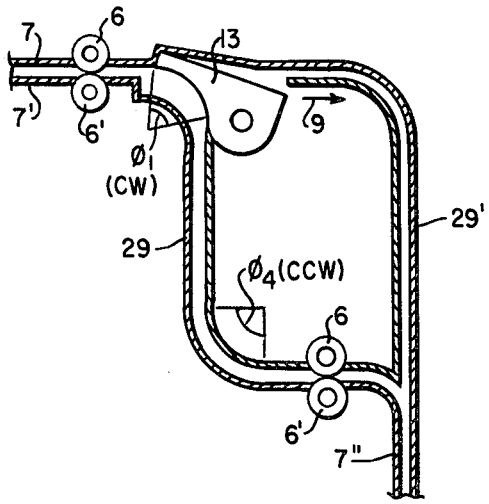
FIG. 13

6
6'
7"
7'
12
ø3
11
R3
L2
R2
ø2
17
17'
L3
16
LT
13
ø1
R1
L1
R4
ø4
8
3
3
LT
α
A
A
B
B
D2
D1
α
6
Os
9
9
4
10
6'
7"
7
7'

JOB SEPARATION BY A SKEWED TROUGH IN THE PAPER PATH

REFERENCE TO RELATED APPLICATION

This application is a continuation-in-part of copending application Ser. No. 727,873, filed on Sept. 29, 1976, in the name of Michael K. Bullock, and commonly assigned, now abandoned.

BACKGROUND OF THE INVENTION

In copier/duplicator systems and in duplicator/-printer systems, there is need for providing job separation of the sheets fed to the collection station as the output of the equipment. For example, in a duplicator/-printer system, there are two collection stations, one for use when the system is operating as a duplicator and another for use when the system is operating as a printer. Typically, the equipment, when functioning in the duplicator mode, either collates the output by collecting the copy sheets in separate bins with a single collated set or job in each bin; or the copy sheets are simply collected in a single stack, uncollated, but with the desired number of copies of each sheet grouped together one on top of the other as separate jobs.

When such equipment is operated in the printer mode, copy sheets are produced from electronic information such as magnetic cards or computers. In this mode, the entire information is printed onto the required number of successive sheets to form an individual print job, with the sheets of the job properly collated. This process is then repeated the required number of times to make the desired number of copies of the job. With the present construction of duplicator/printer systems, the successive jobs are fed to a print exit pocket where they are collected in a single stack.

Where the copy sheets are finally collected in a single stack, uncollated or collated, it is desirable to form the stack in such a way whereby the successive jobs are visually identifiable. For this purpose, it is generally known to offset each job with respect to the next job in the stack. Typical arrangements have included separate sheet feeding mechanisms alternately operable on the sheets of each successive job. With this type of construction, each alternate job is fed into the stack by one or the other of the feeding mechanisms which are arranged to effect the offset relation. Other devices for offsetting successive jobs in a single stack involve oscillating the collecting bin in which the stack is collected. In particular, the bin is moved to one position for receiving every other job while it is moved to the second position for receiving the remaining jobs. The successive jobs therefore become offset laterally in the formed stack. Still another arrangement for offsetting jobs collected in a single stack includes the use of a stop device for controlling the extent to which each job is fed into the collecting bin. With this construction, individual jobs are offset longitudinally of their path of movement into the bin.

SUMMARY OF THE INVENTION

According to the teachings of the present invention, job separation is produced by laterally offsetting the sheets of each job with respect to their direction of travel toward the collecting bin in which they are to be stacked. For producing this lateral offset, the sheets are diverted from their original path of travel into a curved path formed about an axis which is skewed relative to the direction of travel of the sheets in their original path. After this skewed travel, the sheets are fed back into the original path. At this point, the sheets are moving along the path in laterally offset relation to their original positioning on the path.

To effect job separation of each successive copying or printing job, the sheets of each alternate job may, for example, be diverted through the curved skewed path while the remaining jobs are kept to their original path. The successive jobs may then be collected in a single stack and each will be visually identifiable by their relative lateral offsetting. It is also within the teachings of the present invention to offset just the first or last sheet of each successive job as it travels toward the collecting bin. It will be apparent that this procedure will provide the same type of visual indication of the separated jobs when collected in a single stack.

In construction, the curved path for offsetting the sheets is provided by curved guide structure extending across the original path of travel of the sheets toward the collecting bin. The guide structure is formed into a curved shape about an axis which is skewed relative to the direction of travel of the sheets along the original path. The curved shape may be in either the form of a U-shaped trough or in the form of a loop. Positive drive means is advantageously provided both before and after the trough or loop for positively feeding the sheets in their original predetermined direction. The spacing of these drive means is such that the sheets will remain under their control as they are directed through the guide structure. This is significant in that the sheets will thereby always remain under positive control.

In order to divert the desired sheets of the jobs through the guide structure, a diverter is positioned in the path of travel of the sheets at the entrance to the guide structure. This diverter is actuated automatically to selectively direct the sheets either through the guide structure or straight along their original path toward the collecting bin.

The foregoing and other features and advantages of the invention will be apparent from the following more particular description of preferred embodiments of the invention, as illustrated in the accompanying drawing.

BRIEF DESCRIPTION OF THE DRAWING

FIG. 1 is a schematic view of a duplicator/printer system incorporating the offsetting apparatus of the present invention;

FIG. 13 is a schematic side view of a guide structure wherein the sheet input and output are not parallel;

DETAILED DESCRIPTION OF THE PREFERRED EMBODIMENTS

FIG. 1 represents a duplicator/printer system in which the offsetting apparatus of the present invention is used. Generally, the system includes a feeding mechanism 1 for feeding sheets from the system's copying or printing station 2 to the bin-type collection station 3. The offsetting apparatus generally shown at 4 is located along the feeding mechanism at the entrance to the collection station 3. A control panel 5 is provided for setting the system for a particular mode of operation as, for example, a duplicating mode or printing mode and for setting other operating functions including the control of the offsetting apparatus as more fully described below.

Figures 2, 3:
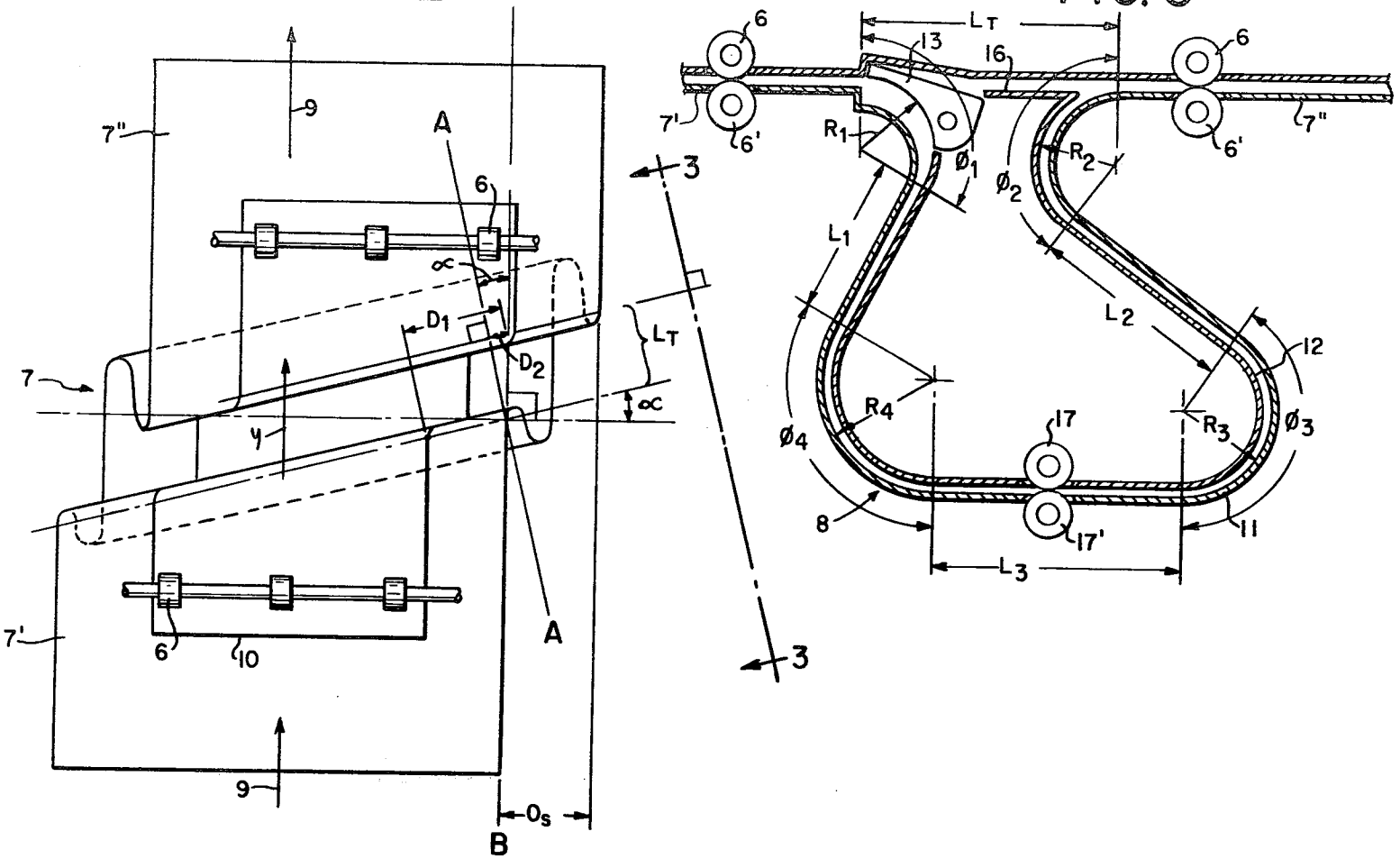
FIG. 2 is a schematic plan view showing the configuration of a trough-shaped guide structure for effecting lateral offsetting of sheets fed therethrough.
FIG. 3 is a cross-sectional view taken along lines 3—3 of FIG. 2.

The feeding means for feeding the sheets includes sheet drive rollers 6 placed along the path of travel of the sheets. These drive rollers are positively driven against the sheet as the sheet moves between the drive roller and a cooperating idler roller 6'. As shown in FIGS. 2 and 3, the sheet support surface 7 is divided into first and second sections 7' and 7'' which are spaced from each other but which lie in a common plane. The guide structure for effecting lateral offsetting the sheets includes a trough 8 connecting the first and second sections 7', 7'' and extending therebetween at an angle skewed relative to the original direction of travel of the sheets on the surface 7. This direction of travel is represented by the arrows 9.

As sheet 10 is shown in FIG. 2 in the process of being fed through the trough. As indicated, the leading end of the sheet has passed completely through the trough and has been directed back into its original path of travel on the second section 7'' of the support surface 7 while the trailing end of the sheet has not yet been diverted from the first section 7' of the surface 7 into the trough. In order to maintain positive control of the sheet throughout its path of travel through the trough, a pair of sheet feeding rollers 6 is positioned closely adjacent to the trough both on the input and output sides thereof. The trough is dimensioned so that the distance between the two pairs of rollers 6 is less than the length of the paper as measured along its path of travel through the trough.

it will be seen from FIG. 2 that sheets which pass through the trough become laterally offset with respect to their direction of travel 9. The amount of sheet offset is shown at $O_s$. For purposes of the mathematical calculations used in determining the configuration of the trough, the offset $O_s$ is also shown in FIG. 2 with respect to the edge of the guide structure. The offsetting of each sheet is effected without changing its ultimate direction of travel 9. This is advantageous in that all sheets passing through the skewed trough will have the same direction of travel as sheets which are not fed through the trough and will thus be parallel to such sheets. This result is achieved by appropriately configuring the trough as explained below.

FIG. 3 shows in more detail the construction of the guide structure for forming the trough. In particular, it is comprised of a pair of wall members 11 and 12 which closely overlie each other to contain the paper as it is fed through the trough. The double wall members are used since the sheets must traverse a path which includes reversed turns. The outer wall 11 contains the sheets for making turns in the counterclockwise direction while the inner wall 12 contains the sheets as they are turning in the clockwise direction.

Although a continuous double wall construction is shown, it is within the scope of the invention to use other mechanisms for guiding the sheets through their curved path. For example, strategically placed guide surfaces at the proper orientation with respect to the curved portions of the trough may be used to hold the sheets against either the wall surface 11 or wall surface 12.

In order to divert the sheets through the skewed trough, a diverter 13 is provided. As shown in FIG. 3, the diverter is located at the entrance to the trough in the path of movement of the sheets along the first section 7' of the sheet support surface 7. A support surface 16 located over the trough provides the necessary support for the sheets not passing through the trough.

The diverter is actuated by any conventional means as, for example, a counter 14 in the control panel. The counter is connected to a solenoid 15 for selectively shifting the diverter from the position shown in FIG. 3 to a lower position permitting the sheets to be fed over the trough.

The shape of the trough creating a particular amount of offset ($O_s$) may be calculated mathematically knowing the following parameters which are shown in FIGS. 2 and 3.

$\alpha$ = the angle of skew of the trough $L_t$ = the length of the trough as measured transverse to its axial direction $\phi_1$, $\phi_2$, $\phi_3$ and $\phi_4$ = the curved sections of the trough as measured in radians $R_1$, $R_2$, $R_3$ and $R_4$ = the radii about which the corresponding curves $\phi_1$, $\phi_2$, $\phi_3$ and $\phi_4$ are formed $L_1$, $L_2$, and $L_3$ = the length of the planar portions of the trough Axis A-A = the axis representing the direction of travel of the sheets while under a skewing influence Axis B-B = the axis representing the original direction of travel 9 of the sheets $D_1$ = the amount that the trough offsets the sheets with respect to the axis A-A $D_2$ = the amount the paper would have been offset with respect to the axis A-A had it not gone through the trough As indicated above, it is desirable to have the sheets which are fed through the trough parallel to the sheets which are not fed through the trough. This result is most conveniently obtained where the trough is constructed with a uniform cross-sectional shape and with $\phi_1+\phi_2=\phi_3+\phi_4$, or in other words, where the amount of clockwise rotation of the sheets as they travel along the curves $\phi_1$ and $\phi_2$ equals the amount of counterclockwise rotation as they travel along curves $\phi_3$ and $\phi_4$.

Considering the structure of FIG. 3, wherein $\phi_1=\phi_4$ and $\phi_2=\phi_3$, and ignoring sheet thickness and the separation of the inner and outer walls such as 12 and 11, the basic equation for calculating offset $O_s$ is:

$$O_s=(D_1-D_2)\cos\alpha \qquad \text{(Equation 1)}$$

$D_1$ and $D_2$ can be calculated by the following equation:

$$D_2=L_t\tan\alpha \qquad \text{(Equation 2)}$$

$$L_t=R_1\cos(\phi_1-\pi/2)-L_1\sin(\phi_1-\pi/2)+R_4\cos(\phi_1-\pi/2)+L_3+R_3\cos(\phi_2-\pi/2)-L_2\sin(\phi_2-\pi/2)+R_2\cos(\phi_2-\pi/2)=(R_1+R_4)(\cos(\phi_1-90/2))+(R_2+R_3)(\cos(\phi_2-\pi/2))-L_1\sin(\phi_1-\pi/2)-L_2\sin(\phi_2-\pi/2)+L_3 \qquad \text{(Equation 3)}$$

$$D_1=\frac{2\pi R_1\phi_1}{2\pi}\tan\alpha+\frac{2\pi R_2\phi_2}{2\pi}\tan\alpha+\frac{2\pi R_3\phi_2}{2\pi}\tan\alpha+\frac{2\pi R_4\phi_1}{2\pi}\tan\alpha+L_3\tan\alpha+L_2\tan\alpha+L_1\tan\alpha=((R_1+R_4)\phi_1+(R_2+R_3)\phi_2+L_1+L_2+L_3)\tan\alpha \qquad \text{(Equation 4)}$$

substituting equations 2, 3 and 4 into equation 1:

$$O_s=\cos\alpha(-((R_1+R_4)\cos(\phi_1-\pi/2)+(R_2+R_3)\cos(\phi_2-\pi/2)-L_1\sin(\phi_1-\pi/2)-L_2\sin(\phi_2-\pi/2)+L_3)\tan\alpha+((R_1+R_4)\phi_1+(R_2+R_3)\phi_2+L_1+L_2+L_3)\tan\alpha) \qquad \text{(Equation 5)}$$

reducing equation 5:

$$O_s=\sin\alpha((R_1+R_4)(\phi_1-\cos(\phi_1-\pi/2))+(R_2+R_3)(\phi_2-\cos(\phi_2-\pi/2))+L_2(\sin(\phi_2-\pi/2)+1)+L_1(\sin(\phi_1-\pi/2)+1) \qquad \text{(Equation 6)}$$

In the construction shown in FIGS. 2 and 3 where the input and output of the trough are in the same plane, that is, the plane of the sheet supporting surfaces 7' and 7'', it is desirable to minimize $D_2$. This is so since $D_2$ nets no offset with respect to the axis B-B (direction of travel 9). This means that $L_t$ should be minimized since $D_2$ is proportional to $L_t$ for a given $\alpha$. (See equation 2.)

In the construction of FIGS. 2 and 3, the sheet drive rollers 6 adjacent to input and output of the trough are spaced from each other so that sheets passing through the trough will be under the control of at least one of these rollers at all times. In some situations, however, the length of the path through the trough may be greater and the sheets will not be maintained under the control of one or the other of the drive rollers 6. Where this is the situation, a third pair of drive rollers may be provided directly in the trough.

In accordance with the teachings of the present invention, the skewed trough is formed to accommodate an additional set of drive rollers 17 driven by the same drive as used for the rollers 6. This is accomplished by having the axis of rotation of the rollers 17 parallel to the axis of rotation of the rollers 6. For this purpose, the trough is shaped so that it has a surface $L_3$ which is disposed in a plane parallel to the plane (surface 7') in which the sheet originally travels. As the sheet is moving along surface $L_3$, it is not being offset and, therefore, the rollers 17, and their cooperating idler rollers 17', can be aligned in the same direction as the rollers 6. From FIGS. 2 and 3 and the above equations, it can be seen that surface $L_3$ is parallel to the surface 7'. First, the amount of clockwise rotation of the paper as it passes through the first two curves is equal to the amount of counterclockwise rotation, that is, $\phi_1=\phi_4$. Secondly, $L_3$ drops out of equation 5 when it is reduced to equation 6.

Figure 4:
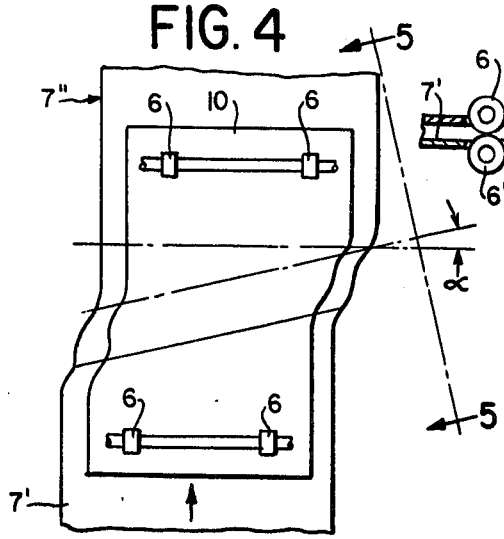
FIG. 4 is a schematic plan view showing another embodiment of the trough-shaped guide structure.
Figure 5:
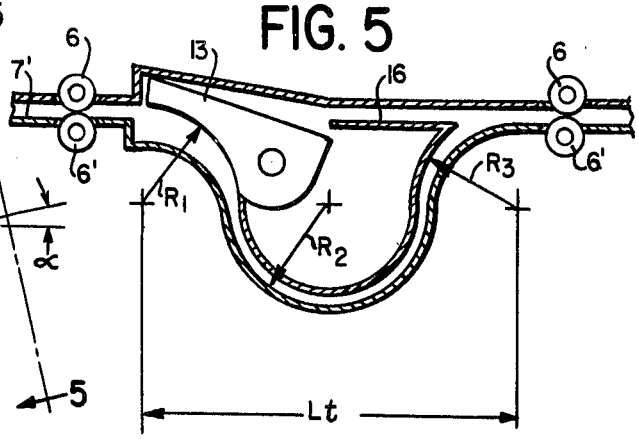
FIG. 5 is a cross-sectional view taken along lines 5—5 of FIG. 4.

FIGS. 4 and 5 show a modified construction of the skewed trough for effecting lateral offsetting of the sheets. In this construction, the curved path formed by the trough is not as severe as it is in the construction of FIGS. 2 and 3. Generally, a construction like that of FIGS. 4 and 5 will produce less of an offset where the angle of skew $\alpha$ and the length of the trough $L_t$ are equal to like parameters of FIGS. 2 and 3. In the construction shown in FIGS. 4 and 5, the curves of the trough are formed about equal radii, that is, $R_1=R_2=R_3R$. Also, the centers of the radii lie in a common plane which is parallel to the plane in which the sheets are fed along the surface 7. With this construction, the offset $O_s$ can be calculated by the following equation.

$$O_s=2R(\pi-2)\sin\alpha \qquad \text{(Equation 7)}$$

Figure 6:
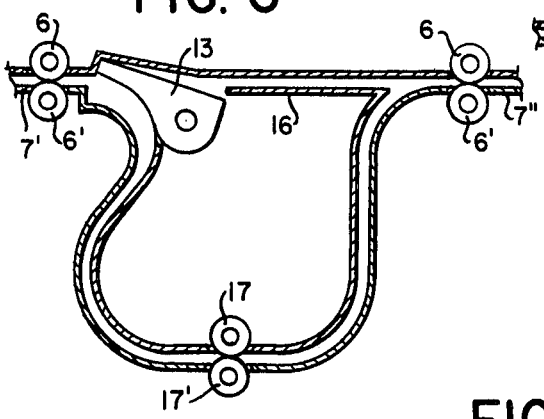
FIG. 6 is a schematic side view similar to FIGS. 3 and 5 showing another embodiment of a trough-shaped guide structure.
Figure 7:
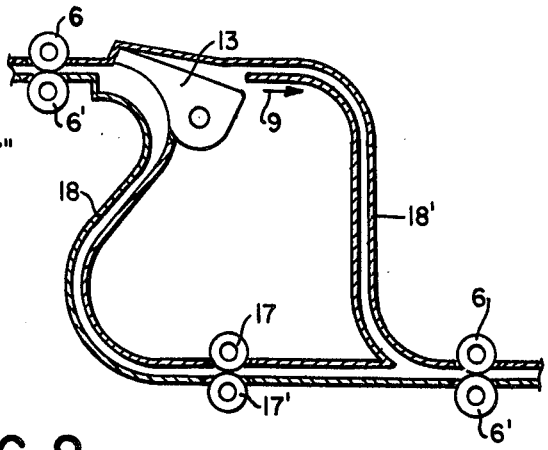
FIG. 7 is a schematic side view showing still another embodiment of a trough-shaped guide structure.

FIGS. 6 and 7 show variations of the skewed trough configuration for effecting offset. In the construction shown in FIG. 6, the trough has a shape which combines curves of the embodiments of FIGS. 3 and 5. More particularly, the left-hand side of the trough includes the double curved configuration of FIG. 3 while the right-hand side includes the less severe curved configuration of FIG. 5.

In the embodiment shown in FIG. 7, the input and output to the skewed trough, as shown at the left of the figure, are disposed at different levels. Such a construction can be used where the original path of travel of the sheets is to be changed from one level to another. In this embodiment, the axes of the curves along the path 18 of the skewed trough are, of course, skewed relative to the direction 9 of travel of the sheets along the surfaces 7', 7''. It is to be noted, however, that the curves along the path 18' are perpendicular to the direction 9 of travel of the sheets along the surfaces 7', 7''.

Figure 8:
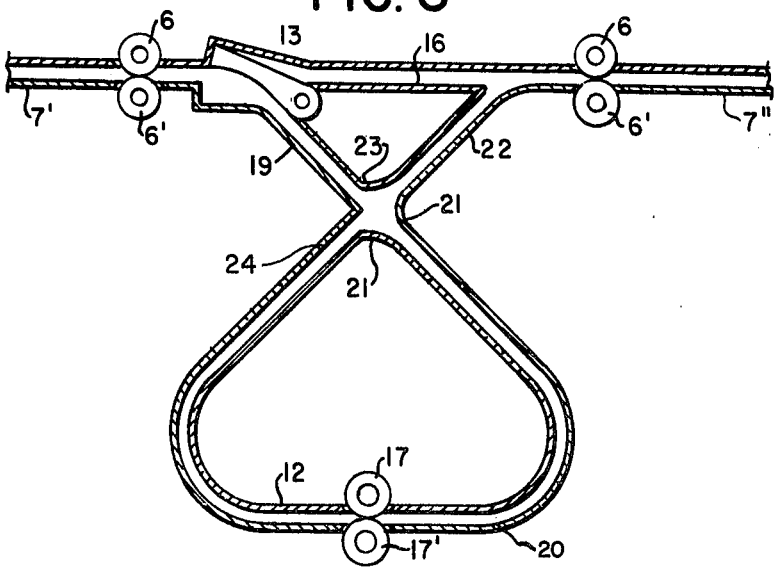
FIG. 8 is a schematic side view showing a loop-shaped guide structure for effecting lateral offsetting of the sheets.

In the construction shown in FIG. 8, the skewed trough configuration is formed in the shape of a loop disposed between the first and second sections 7', 7'' of the sheet supporting surface. The guide structure includes a first guide 19 for initially directing the sheets away from the first section 7' of the support surface 7, a second guide 20 formed in the shape of a loop and a third guide 22 for directing the sheets back onto the second section 7' of the sheet support surface 7. The second guide 20 is spaced from and has an outwardly flared entrance 21 aligned with the first guide 19 while the third guide 22 is spaced from and has an outwardly flared entrance 23 aligned with the exit 24 of the second guide. The exit 24 of the guide 20 and the entrance 23 of the guide 22 are spaced on opposite sides of the entrance 21 to the guide 20.

Figure 9:
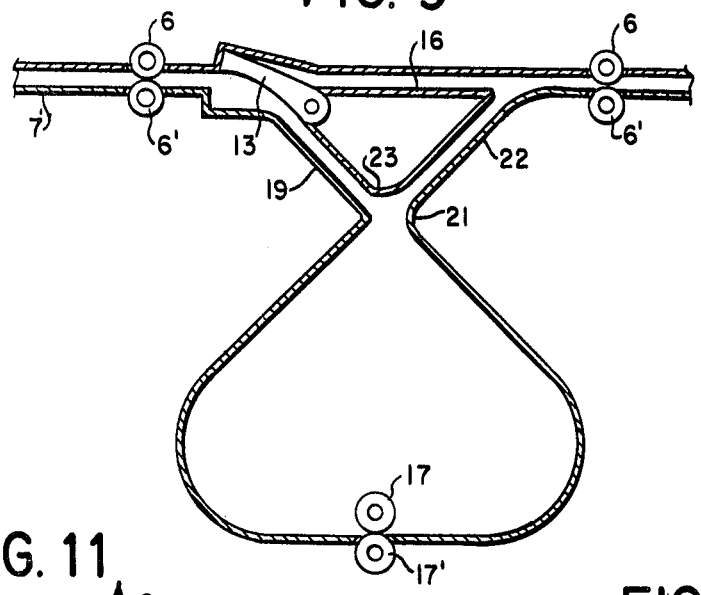
FIG. 9 is a schematic side view of a variation of the guide structure shown in FIG. 8.

In the embodiments shown in FIG. 8, each of the three guides 19, 20, 22 are formed about an axis skewed relative to the original predetermined direction 9 of travel of the sheets along the sheet support surface 7. With this construction, the sheets which are fed through the guides travel in a single rotative direction. With the sheets passing from the left to the right as shown in FIG. 8, this rotative direction will be in the clockwise direction. An advantage of this type of construction is that the double wall construction of the guide is not necessary. In particular, the inner wall surface 12 may be eliminated. Such an arrangement is shown in FIG. 9. The inner wall is not necessary due to the fact that the sheets are moving in a single rotative direction and the centrifugal forces are always acting against the outer wall surface 11.

In each of the constructions shown in FIGS. 3 and 6–9, sheet drive rollers 6 are advantageously positioned adjacent the input and output to the skewed guide structure. Additional rollers 17 driven by a common drive may be employed where necessary by forming the guide structure with an intermediate surface lying in a plane parallel to the plane of the sheet support surface 7.

Rollers 17 of FIGS. 8 and 9 are supported on shafts which are perpendicular to the sheet's spiral feed direction through the trough, and tangent to the cylinderlike surface described by the trough.

Since the counterclockwise rotation of a sheet passing through the skewed trough of FIGS. 8 and 9 does not equal its clockwise rotation, rollers 17, 17′ thereof are not supported on axis parallel to the axis of rollers 6, 6′, but rather the axis of rollers 17, 17′ are normal to the feed direction, i.e., normal to the spiral path described by a point on the sheet as it moves through the trough, and tangent to the cylindrical surface described by this point.

Figure 14:
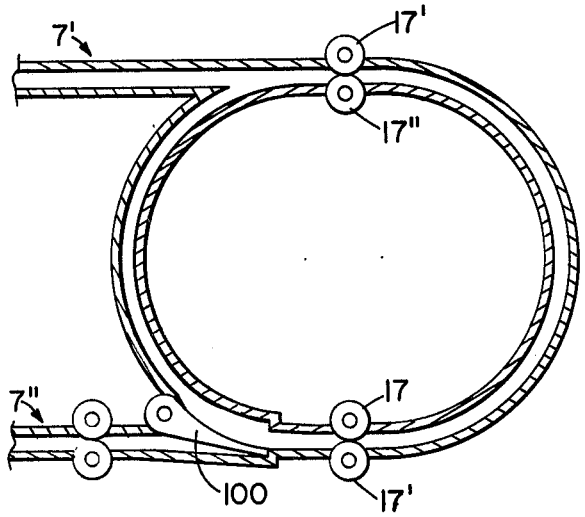
FIG. 14 is a schematic side view, similar to FIGS. 8 and 9, wherein the loop-shaped guide structure for effecting lateral offsetting of the sheets includes a deflector means to facilitate the multiple looping of a sheet in the guide structure, thereby effecting an increment of offset along the axis of the guide structure for each one of such multiple loops.

In the construction shown in FIG. 14, the skewed trough configuration is formed in the shape of a loop disposed between first and second sections 7′, 7″ of the sheet supporting surface. However, in this configuration, a deflector 100 is provided to maintain a sheet in the loop for multiple clockwise turns therethrough. With this configuration, rollers 17 must be provided to maintain the sheet under a drive force during the multiple looping. The drive force imparted to the sheets by these rollers is in their direction of skewed travel, i.e., the rollers are supported on shafts perpendicular to the spiral path traversed by a point on the sheet, and tangent to the cylinder formed by the trough. After a given time has expired, or upon sensing a number of traverses through the loop, as may be desired by one skilled in the art, deflector 100 is actuated and the sheet exits to section 7″. The total offset effected is the amount achieved by a single loop, such as FIG. 8 or 9, multiplied by the number of times the sheet traverses the loop of FIG. 14. This will give the offset achieved by integer numbers of loops. The offset achieved by a partial loop can be calculated similarly to the calculations previously described. Note that these partial loops will result in the sheet's entering lead edge and the exiting lead edge being nonparallel.

Figure 15:
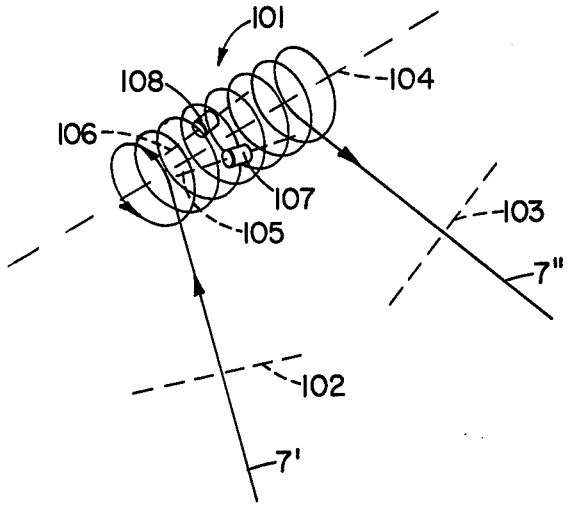
FIG. 15 is a view of the path traversed by a point on a sheet which has passed through approximately seven and one-half loops in a loop-shaped guide structure of the type shown in FIG. 14, wherein the flat surfaces and their drive rollers have been omitted.

FIG. 15 depicts the spiral path 101 followed by a point on a sheet as it multi-loops through a circular cylinder trough of the type shown in FIG. 14. For simplicity the trough of FIG. 15 is circular in cross section, i.e., the flat area associated with FIG. 14's roller pairs 17, 17′ have been eliminated. As used herein, the term spiral path is intended to mean the path of a point in the plane of a sheet, as the sheet moves around the axis of the skewed trough. Thus, should the trough be provided with flat areas, the spiral path would have corresponding straight segments. The sheets approaches the trough with its leading edge disposed as shown by broken line 102. The point being considered is traveling along straight line 7′. As the sheet enters the trough, this point describes a spiral path 101, makes approximately seven and one-half loops, and exits at 7″. The sheet's leading edge is now disposed as at 103.

The skewed axis of the trough is represented by broken line 104. At any given point in spiral path 101, an axis such as 105 or 106 can be drawn normal to path 101 and tangent to the cylinder described by this point. Drive rollers, such as 107 and 108, are supported on these axes and impart drive force to the sheet as it traverses the spiral path. Because the tangency point described herein is in fact a "point", the drive rolls 107 and 108 and their associated idlers, not shown, would have to be infinitely thin in order to perfectly drive the paper. Therefore, very narrow drive rolls and idler rollers should be used, or the drive rolls should be positioned on flats as shown in FIG. 14.

In the arrangements of FIGS. 14 and 15, the entire sheet is bent to conform to the loop guide's configuration during multiple looping. The length of the loop defined by the guide is such that the leading and trailing sheet portions do not overlap, i.e., a gap exists between the two ends of the sheet as it multi-loops through the guide.

Figure 10:
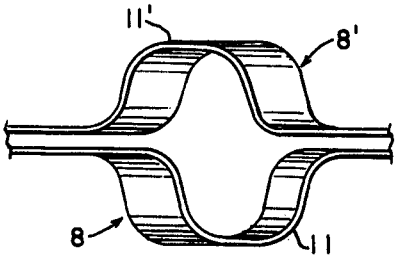
FIG. 10 is a schematic side view of guide structure providing two opposed skewed troughs for effecting lateral offsetting of the sheets.

FIG. 10 shows a construction where two opposing skewed troughs 8 and 8′ are employed. For simplicity, only the outer wall structure 11, 11′ of these guides is shown, it being understood, however, that the double wall structure of the previous embodiments will be employed. With the construction of FIG. 10, the lateral job separation is produced by feeding one job through one trough and the next job through the other trough with one trough offsetting the job laterally to one side of the predetermined direction 9 and the other trough offsetting alternate jobs to the other side of the predetermined direction 9. An advantage of this embodiment resides in the fact that the length of travel of all sheets will be the same. This may be desired to accommodate the offsetting apparatus for use in systems where the control of the sheets for other processing operations is determined by their location at a particular point in time. With the double trough, the sheets will exit with their original spacing along the direction 9 undisturbed.

Figure 11:
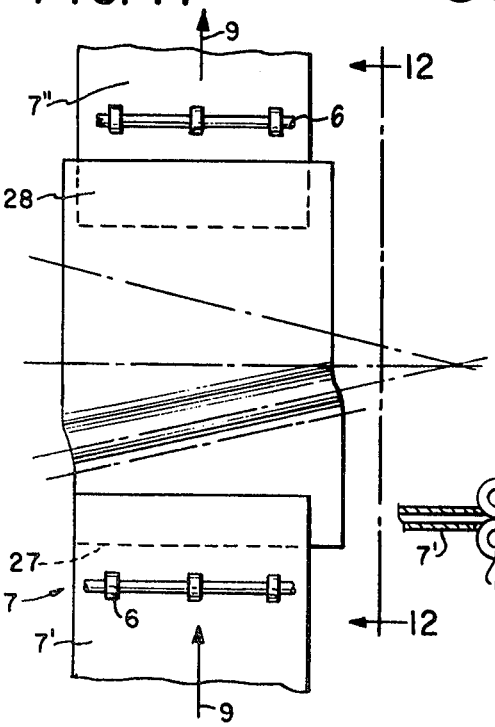
FIG. 11 is a schematic plan view of a trough-shaped guide structure wherein the skewed angle of the trough is variable.
Figure 12:
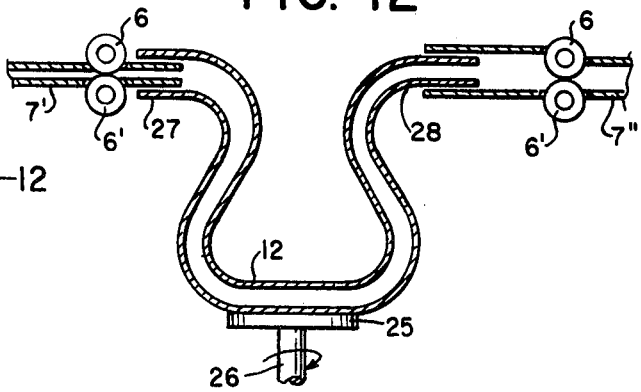
FIG. 12 is a view taken in the direction of lines 12—12 of FIG. 11.

FIGS. 11 and 12 show a trough construction which is adjustable so that the amount of skewing of the trough relative to the predetermined direction 9 can be varied. For this purpose, the entire trough is made as an integral unit separate from the sheet feeding means 6 and support surfaces 7′, 7″. The unit is mounted on a platform 25 which is supported on a rotating shaft 26. As will be evident from FIGS. 11 and 12, rotation of the trough guide structure about the axis of the shaft 26 will change the angle of skew of the trough relative to the direction 9. To permit rotative movement of the trough construction of FIG. 12 without interfering with the sheet travel, the left-hand portion of the guide structure as shown at 27 underlies the first section 7′ of the sheet support surface 7 while the right-hand portion 28 overlies the second section 7″ of the sheet support surface 7.

With the construction shown in FIGS. 11 and 12, all the sheets can be fed through the trough with offsetting of one job relative to another being effected by control of the rotative position of the trough. It is, of course, possible to use this construction with a diverter for feeding sheets across the trough if this is desirable.

FIG. 13 shows a construction in which the input and output to the skewed trough are disposed in paths lying along intersecting planes rather than in a common plane or in parallel planes. In FIG. 13, the path of the skewed trough is represented by the reference numeral 29 while the path of the sheet when not fed through the skewed trough is represented by the reference numeral 29'. The first two curved sections $\phi_1$ and $\phi_4$ encountered by the sheets as they enter the trough from the support surface 7' are skewed relative to the direction 9 of travel of the sheets along the surfaces 7' and 7''. The amount of clockwise rotation imparted to the sheets as they pass through the curved section $\phi_1$ equals the amount of counterclockwise rotation as they pass through the curved section $\phi_4$. The sheets are thus laterally offset from their original position on the surface 7' and have their leading and trailing edges disposed parallel to the sheets which are fed along the path 29'. To maintain this parallel relationship, the final curved sections of the path 29, where it intersects with the path 29', is formed along an axis which is perpendicular to the direction 9 of travel of the sheets along the surfaces 7' and 7''. Of course, it will also be apparent that the path 29 is similarly curved along an axis perpendicular to the direction 9. With the above construction offsetting of the sheets passing through the trough configuration is effected while the path of travel of the sheets is changed from one plane to another non-parallel plane.

In each of the embodiments described above, it is preferred to have all the sheets collected in one stack with their front edges parallel to each other. As explained, this is accomplished by constructing the trough with the amount of clockwise rotation equal to the amount of counterclockwise rotation. If the sheets are to be skewed as they pass through the trough, the amount of clockwise rotation will be made unequal to the amount of counterclockwise rotation. Where this construction is used, the sheets exiting from the trough back into the path of feeding of the other sheets not going through that trough will have their front edges skewed relative to the front edges of the other sheets. Where the sheets are skewed this way, the normal drive rollers 6 at the exit of the trough will not be used or will be replaced with drive rollers having their axes of rotation properly aligned for the sheets. With reference to the drawings, the embodiment of FIG. 10, without drive rollers, will skew the sheets in either of the troughs if the clockwise and counterclockwise rotation are made unequal.

While the invention has been particularly shown and described with reference to preferred embodiments thereof, it will be understood by those skilled in the art that various changes in form and details may be made therein without departing from the spirit and scope of the invention.

What is claimed is:

1. Apparatus for offsetting sheets laterally with respect to their path of travel in a predetermined direction comprising:

(a) feeding means for feeding sheets in a predetermined direction and with predetermined orientation to said direction, first in one plane along a first section of said path and then along a second section of said path, the first and second section of said path being disposed in the same plane, said sheets being in said predetermined orientation, but offset, when resident in said second section of said path;

(b) trough shaped guide means connecting said two sections and extending out of said plane in skewed relation to said predetermined direction, said guide means comprising a plurality of serially disposed and individual skewed turns, each individual turn of which is formed about an axis skewed relative to said predetermined direction, and each such axis being parallel with each other such axis and being containable within a plane parallel to a sheet while it is in the first section of said path; and (c) control means for directing sheets from the first section of said path, through said guide means and onto the second section of said path as they are being fed in said predetermined direction along the first and second sections of said path.

2. The apparatus according to claim 1 wherein:

(a) the guide means is U-shaped in cross-section, with the bottom of the U-shaped being enlarged and the top constricted.

3. Apparatus for offsetting sheets laterally with respect to their path of travel in a predetermined direction comprising:

(a) feeding means for feeding sheets in a predetermined direction and with predetermined orientation to said direction, first in one plane along a first section of said path and then along a second section of said path, said sheets being in said predetermined orientation, but offset, when resident in said second section of said path;

(b) guide means, U-shaped in cross-section and comprising a pair of closely spaced overlying surfaces between which sheets are guided, connecting said two sections and extending out of said plane in skewed relation to said predetermined direction, said guide means comprising a plurality of serially disposed and individual skewed turns, each individual turn of which is formed about an axis skewed relative to said predetermined direction, and each such axis being parallel with each other such axis and being containable within a plane parallel to a sheet while it is in the first section of said path; and (c) control means for directing sheets from the first section of said path, through said guide means, and onto the second section of said path as they are being fed in said predetermined direction along the first and second sections of said path.

4. Apparatus for offsetting sheets laterally with respect to their path of travel in a predetermined direction comprising:

(a) feeding means for feeding sheets in a predetermined direction and with predetermined orientation to said direction, first in one plane along a first section of said path and then along a second section of said path, said sheets being in said predetermined orientation, but offset, when resident in said second section of said path;

the feeding means including a support surface extending along the first and second sections of said path and over which said sheets are fed, and first and second drive roller means located respectively at the first and second sections of said path for drivingly feeding said sheets in said predetermined direction along said support surface;

(b) guide means, including a guide surface disposed in a plane parallel to said one plane, connecting said two sections and extending out of said plane in skewed relation to said predetermined direction, said guide means comprising a plurality of serially disposed individual skewed turns, each individual turn of which is formed about an axis skewed relative to said predetermined direction, and each such axis being parallel with each other such axis and being containable within a plane parallel to a sheet while it is in the first section of said path;

(c) control means for directing sheets from the first section of said path, through said guide means and onto the second section of said path as they are being fed in said predetermined direction along the first and second sections of said path; and (d) third drive roller means located along said guide surface for drivingly feeding said sheets parallel to said predetermined direction;

the distance between said first and second drive roller means, as measured along the path of travel of said sheets through said guide means, being less than the dimension of said sheets as measured along its path of travel.

5. Apparatus for offsetting sheets laterally with respect to their path of travel in a predetermined direction comprising:

(a) feeding means for feeding sheets in a predetermined direction and with predetermined orientation to said direction, first in one plane along a first section of said path and then along a second section of said path, said sheets being in said predetermined orientation, but offset, when resident in said second section of said path;

the feeding means including a support surface extending along the first and second sections of said path and over which said sheets are fed, and first and second drive roller means located respectively at the first and second sections of said path for drivingly feeding said sheets in said predetermined direction along said support surface;

(b) trough shaped guide means having a flat bottom surface disposed in a plane parallel to said one plane, connecting said two sections and extending out of said plane in skewed relation to said predetermined direction, said guide means comprising a plurality of serially disposed individual skewed turns, each individual turn of which is formed about an axis skewed relative to said predetermined direction, and each such axis being parallel with each other such axis and being containable within a plane parallel to a sheet while it is in the first section of said path;

(c) control means for directing sheets from the first section of said path, through said guide means, and onto the second section of said path as they are being fed in said predetermined direction along the first and second sections of said path; and (d) third drive roller means located along the bottom surface of said guide means for drivingly feeding said sheets in said predetermined direction.

6. The apparatus according to claim 5 wherein:

the shortest distance between any of said first, second and third drive roller means, as measured along the path of travel of said sheets, is less than the dimension of a sheet as measured along said path.

7. The apparatus according to claim 6 wherein:

(a) said control means includes:

(1) a diverter disposed in the path of movement of said sheets along said first section thereof, and (2) means for selectively actuating said diverter to selectively direct sheets from said first section either directly to said second section or to said guide means; and (b) said apparatus further comprising:

(1) stacking means located along said predetermined direction and beyond said second drive roller means for collecting said sheets in a single stack with the sheets directed through said guide means offset laterally relative to the sheets fed directly to the second section of the feeding means.

8. Apparatus for offsetting sheets laterally with respect to their path of travel in a predetermined direction comprising:

(a) feeding means for feeding sheets in a predetermined direction and with predetermined orientation to said direction, first in one plane along a first section of said path and then along a second section of said path, said sheets being in said predetermined orientation, but offset, when resident in said second section of said path;

(b) guide means connecting said two sections and extending out of said plane in skewed relation to said predetermined direction, said guide means forming a loop between said first and second sections for directing sheets passing therethrough in a single rotative direction, said guide means comprising a plurality of serially disposed individual skewed turns, each individual turn of which is formed about an axis skewed relative to said predetermined direction, and each such axis being parallel with each other such axis and being containable within a plane parallel to a sheet while it is in the first section of said path; and (c) control means for directing sheets from the first section of said path, through said guide means, and onto the second section of said path as they are being fed in said predetermined direction along the first and second sections of said path.

9. The apparatus according to claim 8 wherein:

the guide means includes guide surfaces for supporting said sheets against centrifugal forces as they are fed in said single rotative direction through said guide means.

10. The apparatus according to claim 8 wherein:

(a) the feeding means includes first and second support surfaces spaced from each other along said predetermined direction and extending, respectively, along said first and second sections of said path for supporting sheets fed in said predetermined direction; and (b) said guide means includes:

(1) a first guide for directing sheets away from said first support surface, said first guide being curved about an axis skewed relative to said predetermined direction, (2) a second guide spaced from and having an entrance aligned with the first guide for receiving sheets from said first guide, said second guide having a looped curve cross-sectional configuration formed about an axis skewed relative to said predetermined direction with an exit disposed on one side of said entrance for directing sheets thereacross, and (3) a third guide spaced from and having an entrance aligned with the exit of said second guide on the opposite side of said entrance for receiving sheets from said second guide, said third guide being curved about an axis skewed relative to said predetermined direction and having an exit adjacent the second support surface of said feeding means for directing sheets onto said second support surface.

11. The apparatus according to claim 10 wherein:

(a) said control means includes:

(1) a diverter disposed in the path of movement of said sheets along said first section thereof, and (2) means for selectively actuating said diverter to selectively direct sheets from said first section either directly to said second section or to said guide means;

(b) said feeding means includes first and second driver roller means located respectively along said first and second support surfaces for drivingly feeding said sheets in said predetermined direction along said surfaces; and (c) said apparatus further comprising:

(1) stacking means located along said predetermined direction and beyond said second drive roller means for collecting said sheets in a single stack with the sheets directed through said guide means offset laterally relative to the sheets fed directly to the second section of the feeding means.

12. The apparatus according to claim 10 wherein:

(a) the second guide of said guide means is a single sheet supporting surface facing radially inwardly of its curved configuration for supporting said sheets against centrifugal forces as they are fed in said single rotative direction through said guide means.

13. The apparatus according to claim 12 wherein:

(a) the entrances of said second and third guides are flared outwardly away from the path of the sheets into said entrances.

14. Apparatus for offsetting sheets laterally with respect to their path of travel in a predetermined direction comprising:

(a) feeding means for feeding sheets in a predetermined direction and with predetermined orientation to said direction, first in one plane along a first section of said path and then along a second section of said path, said sheets being in said predetermined orientation, but offset, when resident in said second section of said path;

the feeding means including first and second support surfaces spaced from each other along said predetermined direction and extending, respectively, along said first and second sections of said path for supporting sheets fed in said predetermined direction;

(b) guide means connecting said two sections and extending out of said plane in skewed relation to said predetermined direction, said guide means including:

(1) sheet guide structure having an entrance end and an exit end and being curved intermediate said ends about an axis extending transversely of said ends, (2) means mounting said guide structure between the first and second support surfaces of said feeding means with the axis extending transversely of said predetermined direction, and (3) means for rotating said guide structure about an axis extending perpendicular to said one plane for adjusting the skewed relation of said guide means relative to said predetermined direction;

and (c) control means for directing sheets from the first section of said path, through said guide means and onto the second section of said path as they are being fed in said predetermined direction along the first and second sections of said path.

15. The apparatus according to claim 14 wherein:

(a) said guide structure includes:

(1) a first wall member having an entrance end and an exit end and curved intermediate its ends, and (2) a second wall member closely overlying said first wall member for receiving sheets therebetween.

16. The apparatus according to claim 15 wherein:

(a) said control means includes:

(1) means for selectively rotating said guide structure between a first position skewed at an angle to one side of said predetermined direction and a second position skewed to the other side of said predetermined direction to selectively offset sheets to the one or the other side of said predetermined direction while travelling through equal distances along said predetermined direction.

17. The apparatus according to claim 16 further comprising:

(a) stacking means for collecting said sheets in a single stack with the sheets selectively offset laterally relative to each other.

18. The method of offsetting sheets laterally with respect to their initial path of travel in a predetermined direction comprising the steps of:

(a) feeding said sheets in a predetermined direction along a path;

(b) directing said sheets through a loop-shaped path formed about an axis skewed relative to said predetermined direction, the length of said loop-shaped path in the direction of sheet movement being greater than the length of a sheet, such that leading and trailing sheet portions do not overlap;

(c) maintaining said sheet in said loop-shaped path for a plurality of loops therethrough; and (d) directing said sheets out of said loop-shaped path, with said sheets thereby being offset along said axis, the amount of offset being a function of the number of said plurality of loops.

19. The method defined in claim 18 including the step of imparting a drive force to said sheets while resident in said trough, said drive force being directed along the spiral path described by a point on a sheet as the sheet loops through said loop-shaped path.

20. The method of offsetting sheets laterally with respect to their initial path of travel in a predetermined direction comprising the steps of:

(a) feeding each sheet to be offset in a predetermined direction along an initial path in a predetermined direction;

(b) directing each of said sheets from the initial path through a loop-shaped path formed about an axis skewed relative to said predetermined direction, the length of said loop-shaped path in the direction of sheet movement being such that leading and trailing sheet portions do not overlap;

(c) maintaining each of said sheets in said loop-shaped path for a plurality of loops therethrough; and (d) directing each of said sheets from said loop-shaped path into a second path spaced from said first path whereby each of said sheets is offset along said axis, the amount of offset being a function of the number of said plurality of loops.

21. A method defined in claim 20 including the step of maintaining a drive force on the sheets while resident in said loop-shaped path, said drive force being in the direction of the spiral path described by a point on the sheets as the sheets traverse said loop-shaped path for a plurality of loops therethrough.

22. Apparatus for offsetting sheets laterally with respect to their initial path of travel in a predetermined direction comprising:

(a) feeding means for feeding sheets in a predetermined direction along said path;

(b) a loop-shaped trough disposed along said feeding means and defining an axis which is in skewed relation to said predetermined direction, the circumferential length of said trough in the direction of sheet feed being such that leading and trailing sheet portions do not overlap; and (c) means for maintaining sheets within said trough for multiple passes of the sheets around the loop defined thereby, and for thereafter diverting sheets to a further path to thereby offset the sheets along said axis, the amount of offset being a function of said multiple passes.

23. The apparatus defined in claim 22, including sheet drive means disposed in said trough and constructed and arranged to impart a drive force to the sheets, the drive force being along the spiral path described by a point on a sheet as the sheet passes through said trough for said multiple passes.

24. The method of offsetting sheets laterally with respect to their path of travel in a predetermined direction comprising the steps of:

(a) feeding each sheet to be offset in a predetermined direction, first in one plane along a first section of a first path, with an axis of each sheet being normal to said predetermined direction;

(b) directing each of said sheets to be offset from the first section of the first path through a second curved path extending out of said plane and formed about an axis skewed relative to said predetermined direction;

(c) directing each of said sheets from said second path into a second section of said first path spaced from said first section whereby each of said sheets is offset along said axis as the orientation of said axis to said predetermined direction remains unchanged;

(d) feeding sheets which are not to be offset laterally directly from the first section of the first path to the second section thereof while maintaining their movement in said predetermined direction; and (e) feeding each of said sheets received in the second section of said first path in said predetermined direction.

25. The method according to claim 24 comprising the steps of:

(a) collecting all of said sheets in a single stack after they are fed to the second section of said first path with the sheets which were directed through said second curved path being offset laterally relative to the sheets fed directly to said second section.

26. Apparatus for selectively offsetting sheets laterally with respect to their path of travel in a predetermined direction comprising:

(a) feeding means for feeding sheets in a predetermined direction and with predetermined orientation to said direction, first in one plane along a first section of said path and then along a second section of said path;

(b) guide means connecting said two sections and extending out of said plane in skewed relation to said predetermined direction;

(c) a diverter disposed in the path of movement of said sheets along said first section thereof;

(d) means including said diverter for directing sheets from the first section of said path, through said guide means and onto the second section of said path as they are being fed in said predetermined direction along the first and second sections of said path, such sheets being in said predetermined orientation, but offset, when resident in said second section of said path; and (e) means for selectively controlling said diverter to selectively direct sheets from said first section either directly to said second section or to said guide means.

27. The apparatus according to claim 26 further comprising:

(a) stacking means for collecting said sheets in a single stack with the sheets directed through said guide means offset laterally relative to the sheets fed directly to the second section of the feeding means.

* * * * *